United States Patent [19]

Lerch et al.

[11] 3,950,903

[45] *Apr. 20, 1976

[54] ROOF CONSTRUCTION

[75] Inventors: Adolph F. Lerch, Valencia; Nick C. Otis, Monroeville; John D. Montgomery, Washington, all of Pa.

[73] Assignee: Advance Housing Corporation, Pittsburgh, Pa.

[ * ] Notice: The portion of the term of this patent subsequent to Nov. 13, 1990, has been disclaimed.

[22] Filed: Nov. 12, 1973

[21] Appl. No.: 414,720

Related U.S. Application Data

[60] Continuation-in-part of Ser. No. 339,152, March 8, 1973, Pat. No. 3,812,638, which is a division of Ser. No. 160.846, July 8, 1971, Pat. No. 3,771,269.

[52] U.S. Cl. ..... 52/93; 52/223 R; 52/475; 52/478; 52/512

[51] Int. Cl.[2] ..... E04B 7/04

[58] Field of Search ..... 52/223, 640, 225, 641, 52/227, 480, 300, 478, 555, 475, 512, 92, 506, 93

[56] References Cited

UNITED STATES PATENTS

| | | | |
|---|---|---|---|
| 1,004,145 | 9/1911 | Campfield | 52/300 |
| 1,076,290 | 10/1913 | King | 52/14 |
| 1,262,156 | 4/1918 | Adrian | 52/93 |
| 1,988,388 | 1/1935 | Mioton | 52/92 |
| 2,085,146 | 6/1937 | Carlson | 52/300 X |
| 2,280,687 | 4/1942 | Connelly | 52/92 |
| 2,396,829 | 3/1946 | Carpenter | 52/518 X |
| 2,653,553 | 9/1953 | Jacobs | 52/641 |
| 2,847,948 | 8/1958 | Truitt | 52/518 X |
| 3,109,260 | 11/1963 | De Cesare | 52/300 |
| 3,271,921 | 9/1966 | Divoky | 52/747 |
| 3,304,675 | 2/1967 | Graham-Wood et al. | 52/745 X |
| 3,360,892 | 1/1968 | Rosso | 52/93 |
| 3,362,117 | 1/1968 | Van Raden | 52/225 |
| 3,373,534 | 3/1968 | Berridge | 52/550 X |
| 3,488,899 | 1/1970 | Schultz et al. | 52/14 |
| 3,662,509 | 5/1972 | Studzinski | 52/478 X |
| 3,668,828 | 6/1972 | Nicholas et al. | 52/93 X |
| 3,798,853 | 3/1974 | Castle | 52/92 |

FOREIGN PATENTS OR APPLICATIONS

| | | | |
|---|---|---|---|
| 1,477,830 | 4/1966 | France | 52/92 |
| 689,314 | 3/1953 | United Kingdom | 52/478 |

*Primary Examiner*—Ernest R. Purser
*Assistant Examiner*—Leslie A. Braun
*Attorney, Agent, or Firm*—Parmelee, Miller, Welsh & Kratz

[57] ABSTRACT

A roof is provided for a building wherein inverted channels are secured along the tops of side walls of the building, these channels having upright projections at spaced intervals thereon. Rafters of an inverted channel section each has its outer end portion set astraddle one of these projections and is pivotally secured thereto. The confronting inner ends of each two rafters extending from opposite walls are joined together at the peak of the roof. Similar rafters are secured to each slope of the end wall of the building. Prefabricated roof panels with an understructure having transverse inverted channels on the under face thereof are lowered onto the rafters with their inverted channels nesting over the rafters and these channels are then bolted to the rafters. Tie rods are arranged to relieve lateral stresses that would otherwise tend to urge the building side walls outwardly away from each other.

9 Claims, 9 Drawing Figures

ROOF CONSTRUCTION

This application is a continuation-in-part of our application Ser. No. 160,846, filed July 8, 1971 now U.S. Pat. No. 3,771,269, and of our application Ser. No. 339,152, filed Mar. 8, 1973 now U.S. Pat. No. 3,812,638, which is a division of our first above-identified application.

Both of the aforesaid applications which are incorporated herein by reference, the former for a manufacture comprising a building, and the latter for a method of constructing the building, relate to a prefabricated house construction and a method of applying a roof to the same, whereas the present application is for a roof construction and method applicable to most existing or conventional building constructions having oppositely-sloping roof areas joined along a ridge usually but not necessarily positioned on a vertical plane extending longitudinally along the center of the building from one end to the other. This invention is applicable for use on new buildings, particularly dwellings, built along conventional lines, or to the modernization of existing buildings where replacement of the roof structure is necessary or desirable.

BRIEF DESCRIPTION

If this invention is applied to an existing structure, the original roof, including the rafters, are removed but the side and end walls are left intact. In a new building, the exterior walls at the sides and ends are completed as if the conventional roof structure were to be applied. In either case, old or new, the side walls of both and end walls of both are essentially the same for the purposes of this invention. The end walls, which are triangular, slope from opposite sides upwardly to a peak and the side walls are slightly below the level where the end walls start to slope upwardly to the peak, that is, close to the level of the base of the triangular end walls.

A cap strip in the form of an inverted channel section is secured to the top of each of the side walls. For a masonry construction, the cap section is secured in place with anchor bolts at intervals therealong and in a frame structure lag screws are generally used to fit it to the top of the wall. At intervals along the length of each cap strip there is secured an upstanding inverted U-shaped projection of lug. The lower ends of rolled metal rafters of a modified inverted U-shape, commonly called a "double J" section, straddle each such projection and they are pivotally secured thereto. There are similar rafter sections similarly secured to the top of the opposite side wall and the ends of opposing rafter sections on the two walls are brought together and joined at the peak of the roof. These double J sections we term the primary rafters. One of these primary rafter sections is also secured to each of the two slopes defining the tops of the end walls.

The coverings for the roof are prefabricated panels with a sheet metal or plywood deck and a supporting under-structure. This under-structure comprises inverted channels on the same center-to-center spacing as the primary rafters, the channels being shaped to fit or "nest" over the rafters so that after the rafters have been first secured in place the prefabricated roof panels can be set directly on them and bolted into place. Each panel will usually have a covering over the deck of shingles, simulated shingles or the like. More specifically, but without limitation as to other forms, in a simple four-sided building having a gabled roof, each panel will have a length corresponding to the full length of the building, or full length of a section of the building where the roof is a simple gabled roof, but not exceeding the length that may be hauled on a truck. Each panel is rigid enough to be placed edgewise on the truck for transportation several at one time from a place of manufacture to the place where they are to be used. As herein disclosed there are two longitudinally-extending panels on each slope of a double-sloped or gabled roof, both of the same width, or four panels in all, but in narrow buildings there could be fewer, and there may be more in larger structures. Also combinations of different widths may be used where the dimensions of a roof do not economically permit multiples of a single standard width to be used. In the final structure these inverted channel sections extend up and down the slope of the roof, and, for convenience, they will be sometimes termed herein as "secondary rafters". Extending in the direction of the length of the panel between the inverted channels and welded thereto are purplins comprised of channels set edgewise.

With this construction, no ridge pole is required at the peak of the roof to keep the primary rafters spaced because when a roof panel is set down on the primary rafters, the secondary rafters fit over the primary rafters as above explained, thereby rigidly integrating the primary and secondary roof rafters and deck. Bolts which pass transversely through the secondary and primary rafters are put into place to secure the panels to the primary rafters, which in turn are bolted to the projections on the cap strips secured to the tops of the building walls.

In the preferred procedure the outer or lowermost panels which will provide the eaves for the building will first be put into place, one panel being first lifted edgewise by a crane and positioned so that the lower edge of the panel contacts the outer ends of the primary rafters and the lower ends of the secondary rafters are in register with the primary rafters. When so positioned the panel is then swung down to its final sloping position with its secondary rafters fitting over the primary rafters. Then the other outer panel is similarly placed in position on the opposite slope of the roof. This gives rigidity to the roof and the second or upper panels are put in place and lowered, following the procedure hereinafter more fully explained.

With a roof so constructed and assembled, the width of the building is not limited by the width of the load that may be carried on an over-the-road truck, and except for a crane operator, little skilled labor is required on the building site for erecting the roof. Moreover, it becomes possible to provide overhanging eaves on the building without undesirably reducing the inside width of the house or other building.

BRIEF DESCRIPTION OF THE DRAWINGS

The invention may be more fully understood in the following detailed description in conjunction with the accompanying drawings in which.

Figure 2:
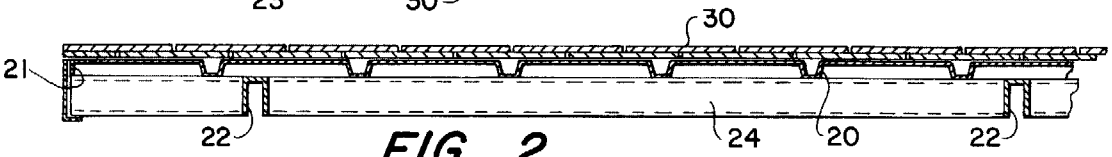
FIG. 2 is a fragmentary longitudinal vertical section through a roof panel constructed according to FIG. 1, the section being in substantially the plane of line II—II of FIG. 1.
Figure 6:
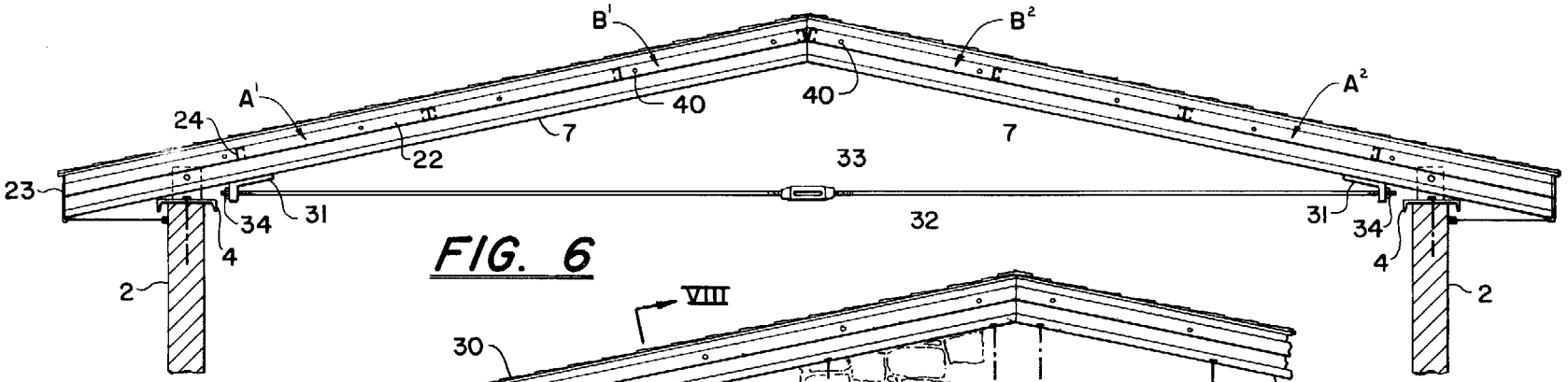
FIG. 6 is a transverse section across a building with the roof in place, showing an interior rafter assembly in elevation.
Figure 7:
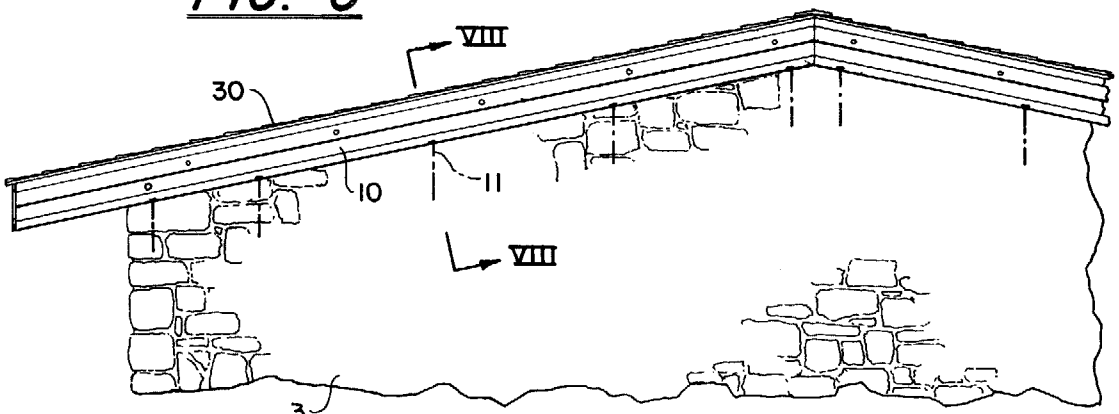
FIG. 7 is a partial end elevation of the building without the roof panel showing in elevation a typical end wall primary rafter assembly.

Referring first to FIGS. 6 and 7, 2 designates the side walls of a conventional building, and 3 is one of two generally similar end walls. As above explained, this may be an old building from which the original roof has been removed or a new building completed to the tops of the sides and end walls. The end walls slope upwardly from each side of the building to a peak. The side walls are at a level just below the base of the triangle defined by the upper portions of the end walls.

Figure 4:
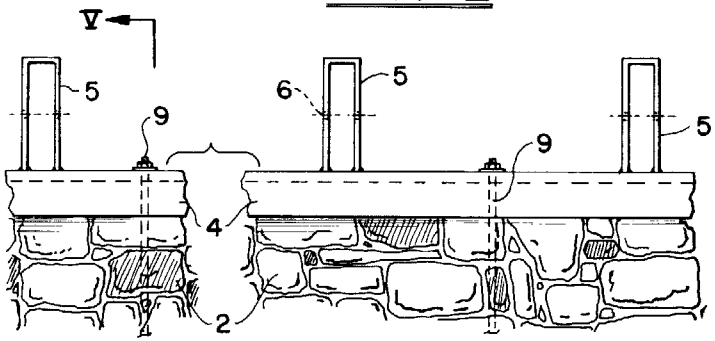
FIG. 4 is a side elevation of the cap strip with a section broken away to indicate indefinite length, the view showing it secured to a side wall.
Figure 5:
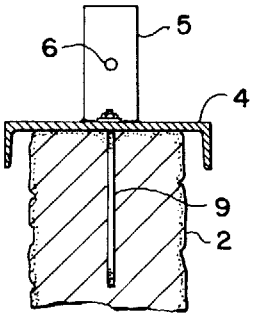
FIG. 5 is a transverse section in the plane of line V—V of FIG. 4.

According to our invention, an inverted channel section 4 is secured along the tops of the side walls (see FIGS. 4 and 5) over the existing wooden cap strip if the building is a frame building, or over the finished top surface of a masonry or brick building. It is desirably of a width somewhat wider than the top of the wall on which it is placed, providing some clearance at each side when the inverted channel is centered on the wall. This inverted channel cap section 4 has upstanding projections 5 secured thereto at regular intervals, which, for example, may be on four-foot centers. Typically they are formed of strap-iron of inverted U-shape with the parallel legs extending crosswise of the length of the section 4 and the lower ends of the legs are welded to the section 4. They are all aligned along the center line of this section. Near their upper ends these projections have aligned holes 6 therethrough as best seen in FIG. 5. These projections may, however, be otherwise formed, as shown for instance in the copending applications.

Figure 3:
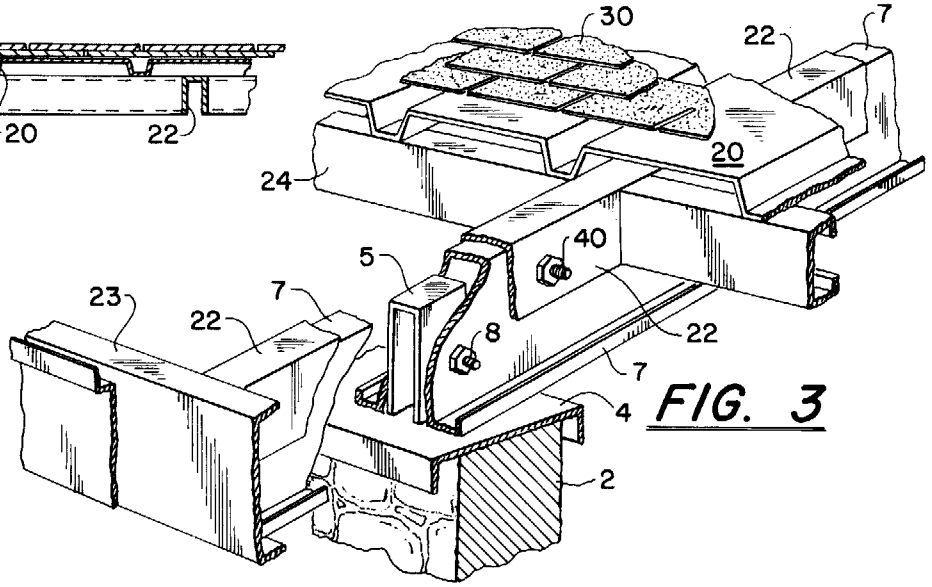
FIG. 3 is a fragmentary perspective view, partly in section, of a portion of the completed roof.
Figure 8:
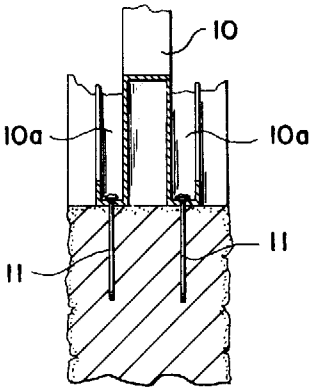
FIG. 8 is a transverse section on a larger scale in the plane of line VIII—VIII of FIG. 7.

The primary rafters, designated 7, are preferably inverted channels with an outwardly-turned flange at the bottom edge of each inverted channel wall, this flange having an upwardly-turned lip, as shown (FIGS. 3 and 8). It is commonly termed a "double J" section and may be rolled from heavy gauge strip on a "Yoder" type mill. Each primary rafter 7 has its outer end portion set astraddle one of the projections 5 and a bolt 8 passing through the sides of the side walls of the primary rafter and through the openings 6 in each projection secure the outer end portions of the respective primary rafters to the projections in such manner that they can swing in a vertical arc to conform to the slope of the roof that they will support.

The inverted cap channel sections are placed on the opposite side walls in such manner that the projections 5 on one side wall are in transverse alignment with those on the other, and the primary rafters are of such length that when they are at the angle of the slope of the roof their free ends come together at the peak and are secured by a connector plate, as described in said applications. After the primary rafters have been joined in this manner, the inverted cap strip channels 4 are secured to the side walls by fasteners 9 which are lag screws in the case of wooden buildings or anchor bolts in the case of brick or masonry walls. The greater width of the sections 4 provide some slight adjustment for irregularities that may be encountered, especially in older buildings.

One of the primary rafter sections is also secured directly to each slope of each end wall. This is shown in FIGS. 7 and 8, in which 10 is a primary rafter section similar to 7 but one of them is positioned on each of the several top slopes of the end walls 3. Fasteners 11 passing through the flanges 10*a* of these sections secure them to the slope on which they are positioned. The arrangement is such that the primary rafters 7 between the end walls and those of the end walls on the same slope of the roof are in a common plane to support the roof panels.

The roof panels are constructed as shown in each of the hereinbefore-named applications. As there shown and also herein illustrated, each slope of the roof cover is comprised of two elongated panels extending lengthwise of the building. The outside or eaves forming panels are designated $A^1$ and $A^2$, and the matching inner ones $B^1$ and $B^2$, respectively (see FIG. 9).

Figure 1:
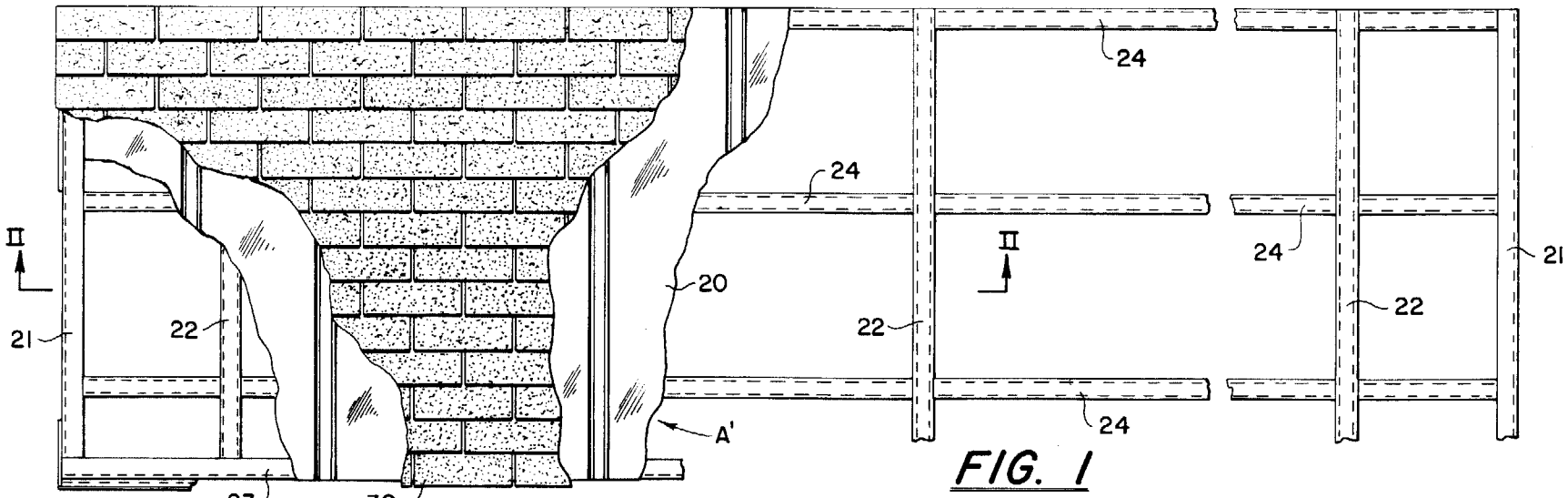
FIG. 1 is a plan view of a single roof panel with portions broken away to show the underlying structure.

Since they are all of generally similar construction, only one of them, $A^1$ as shown in FIGS. 1 and 2 will be described, but it may be noted as here shown, that panels $B^1$ and $B^2$ are narrower than panels $A^1$ and $A^2$, but this is optional, depending on the dimensions of the roof. In these figures 20 designates a corrugated sheet metal deck of a familiar form. At each end of the deck there is an inwardly-facing channel 21 turned edgewise, and at intervals under the deck there are inverted channels 22 parallel with the end channels, the channels 22 being rolled heavy gauge sheet metal sections. They are the sections hereinbefore referred to as the "secondary roof rafters" and typically will be spaced several feet apart, that is, on the same center-to-center distance as the primary rafters. The inverted channels 22 are connected by purlins extending lengthwise of each roof panel.

Figure 9:
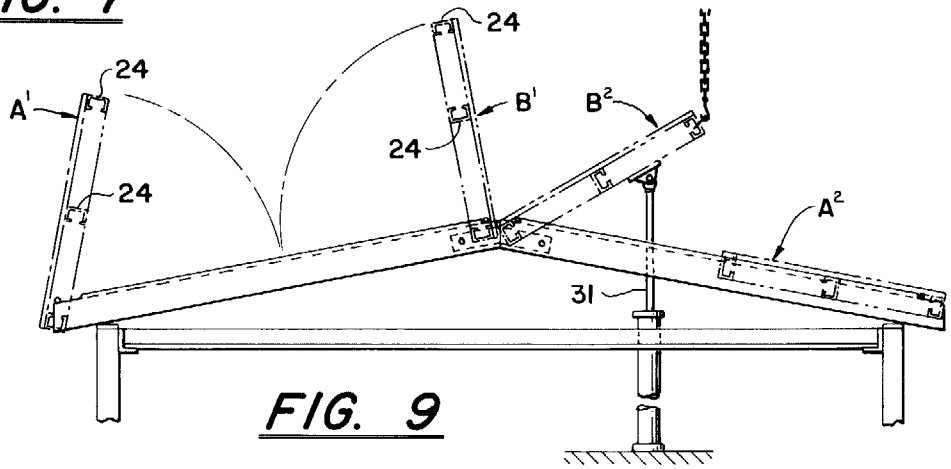
FIG. 9 is a schematic view showing the manner of putting the roof panels in place on the primary rafters.

In the panels $A^1$ and $A^2$ the purlins or elements 23 along the outere edge of the panels, which comprise the eaves of the roof, are channel sections of heavy gauge sheet metal set edgewise and facing inwardly, that is, the flanges of these channel sections turn toward the longitudinal center of the panels and are continuous for the full length of the panel. All of the other purlins, designated 24, extend from one secondary rafter 22 to the next, abutting at their ends against the inverted channels, and they are welded thereto. The purlins are also of rolled heavy gauge sheet metal and are in the form of channel sections set edgewise. Those purlin sections 24 which are along the longitudinal edges of the panels also have their flanges turned inwardly, that is toward the longitudinal center of the panel and toward the members 23 in $A^1$ and $A^2$. This enables the vertical web portions of the purlins of two confronting panels to be joined together in back-to-back relation as shown in FIGS. 6 and 9, both at the ridge of the roof and at the joint between the two panels on the same slope of the roof.

This rigidly connected system of secondary rafters and purlins forms a strong under-structure for the sheet metal deck which is made further rigid by the spaced corrugations formed in the deck itself. The deck is spot welded at intervals to the under-structure. Typically a panel will be as much as sixty feet in length, this being about the maximum that can be hauled on over-the-road trucks. Also the panels may typically be of the order of 6 to 8 feet wide, but these dimensions will vary according to the size and cost of the house. For example with four 6½ foot panels the building may have an overhang at the eaves of the order of 2 feet and still be 22 feet from the exterior of one side wall to the exterior of the other. Moreover, the panels $A^1$ and $A^2$ need not be the same width as panels $B^1$ and $B^2$ but may be wider or narrower.

After the deck and under-structure have been assembled at the fabricating plant, the deck is covered with roofing material, such as composition shingles 30 adhesively secured thereto, both for sound-deadening and to render them more architecturally acceptable. Panels such as these can be prefabricated and readily transferred to a flat bed truck and hauled either flat or edgewise to the building site.

There is a depending lug member 31 secured to the underside of each of the primary rafter sections 7 just inwardly from the projection 5 which it straddles. A tie rod 32 including a turnbuckle 33 extends horizontally from the lug 31 on each of the interior rafters 7 at one side of the building to the similar lug 31 on the opposite rafter to secure the ends of each pair of opposed rafters against spreading apart under vertical loads and also hold the tops of the side walls against stresses tending to urge them apart. The ends of the tie rods 32 pass through holes in the lugs 31 and have nuts 34 at each side of the lug to hold the tie rod against endwise movement in the lug. The continuous roof panels with their secondary rafters fitting or nesting over the primary rafters 7 and 10 tie the end walls against lateral stresses.

With the primary rafters 7 and 10 in place and the tie rods properly tensioned, the prefabricated roof panels may then be put into place. This is accomplished as fully described in said copending application Ser. No. 160,846 by first raising one of the outer panels $A^1$ or $A^2$ edgewise, usually by a crane (not shown) having a chain or cable and hooks which are engaged in openings for that purpose in the innermost purlins 24.

With the panel suspended in a vertical plane, and with its long axis parallel with the length of the building, the panel is lowered until its lower edge, including section 23 at the lower edge is just below the overhanging ends of the rafters, and the inverted channels or secondary rafters are centered with respect to the rafters, as shown in FIG. 9 and the panel is then swung inwardly with its upper edge swinging toward the ridge of the roof. As the panel comes to rest on the rafters, each inverted channel 22 fits over or nests on one of the primary rafters as clearly seen in FIG. 3. With the first roof panel $A^1$ in place, one or more bolts 40 are passed through the inverted channels 22 and the upper portions of the inverted channel or double J primary rafter sections 7 to thereby tie the roof panels to the primary rafters and thus into the building structure.

With one roof panel in place, the rafters are now rigidly fixed against sidewise sway and held the correct exact distance apart at the peak, and the next roof panel $A^2$ at the other side of the building is then placed on and secured to the rafters of the opposite slope of the roof in the same manner. With the panels $A^1$ and $A^2$ in place, the ridge panels $B^1$ and $B^2$ are then put in place. As best seen in FIG. 9 these panels are also lifted edgewise and lowered onto the rafters in an initially generally vertical plane, but the edge of the panel at the ridge is first lowered onto the rafters and then the panel is swung downwardly through an arc toward the upper edge of the panel below. The upper panels are lowered in this way from the ridge toward the outer or lower section so that the edge of the upper panel and especially its shingles will overlap the top of the lower panel. Whether the deck sheet of the upper one slightly overlaps the lower one is a matter of choice, but in any case the shingles or other covering at the lower edge of the upper panel should overlap the upper edge of the lower one.

However, before the panels $B^1$ and $B^2$ can be lowered to their final position, the chains, hooks or cables by which they are lowered must be disconnected, so that, as indicated in FIG. 9, hydraulic or mechanical jack posts 131, preferably two or three of them with one near each end of the panel will support the panel when the hoisting gear of whatever nature is disconnected, and by approximate simultaneous operation of the jacks the final lowering of the ridge panels into position is effected. If, in a narrow building, there is but a single panel on each slope of the roof, only the second panel to be put into place is, if necessary, lowered with the use of jacks. Should it be desirable to have more than two panels on one slope of the roof, each panel after the first would be placed on the roof in the same manner as the ridge panels in order to have a proper overlap of the panels. Other details of procedure more fully disclosed in said pending application Ser. No. 160,846 now U.S. Pat. No. 3,771,269 are usually followed.

When the prefabricated panels are secured in place the roof is essentially complete except a sealing material or mastic will usually be filled into the groove at the peak of the roof where the confronting ridge purlins come together and a cover strip applied over the ridge and secured in place, usually with adhesive weather-resistant cement.

The invention provides an economical and fast method of replacing and strengthening the roof of an old building or applying an original roof to a new building. In replacing a roof on an existing building one must of course prepare the end and side walls in such manner that all of the primary rafters on each slope will be in a common plane. Usually, however, this presents no problem, especially since the metal cap strips, being wider than the sides of the building, provide a little leeway for up and down elevation of the peak of the roof. Also, the metal cap strips may be continuous along the wall from one end to the other, or made in sections, just as long as the upright lugs on both side walls are in transverse alignment and arranged so that the primary rafters will be so spaced that the secondary rafters of the prefabricated roof panels will fit over the corresponding primary rafters in the manner described.

We claim:

1. In a building having spaced opposed side walls, the invention comprising:

a. cap members in the form of inverted channels set astraddle and extending along the top edge of each side wall, b. said cap members having upstanding projections fixed thereto with the projections on one side wall being transversely aligned with those on the other side wall, c. several spaced primary rafter assemblies each separate from the others from one end to the other in the form of inverted channels spanning the space between the two side walls with their opposite ends fitted over each two transversely-aligned projections and secured on said projections and defining the roof contour and slope, d. roof panels extending transversely of the primary rafters carried by said plurality of rafter assemblies having secondary rafter elements thereon extending thereacross, these secondary rafter elements comprising inverted channels that fit over the primary rafter assemblies and in so doing connect the several rafter assemblies in fixed parallel relation, the said panel having a deck to the underside of which the secondary rafters are secured, e. means below the deck securing the secondary rafters to the primary ones, and f. means securing the inverted channel form cap members to the side walls of the building.

2. The invention defined in claim 1 in which there are a plurality of said longitudinally-extending roof panels arranged in side-by-side relation and covering the space spanned by the primary rafter assemblies.

3. The invention defined in claim 2 in which each primary rafter assembly comprises two inverted channel sections joined in abutting end-to-end relation with the two sections diverging downwardly from a peak at their point of juncture to define the opposite slopes of a peaked roof provided by the several roof panels with their secondary rafters nested over the several primary rafters.

4. The invention defined in claim 1 in which the transverse width of the cap members of inverted channel shape is greater than the thickness of the top edge of the respective walls on which they set.

5. The invention defined in claim 1 in which the inverted channels forming the primary rafters are of double J section with a top, spaced sides, a lateral flange along the lower edge of each of the sides and an upstanding flange at the distal edges of said flanges, the overall width of said sections at the base being greater than the width of the secondary channels that fit over the primary ones.

6. The invention defined in claim 3 in which the building has end walls that slope downwardly and outwardly from a peak, and a primary rafter assembly secured to each end wall with the pitch of said last-named assemblies being the same as that of the other primary rafter assemblies, with all primary rafter channels on each slope being in the same plane.

7. The invention defined in claim 3 in which there is a depending lug on each primary rafter section of each primary rafter assembly near the free ends thereof, and adjustable tension rods connecting said lugs to tie the free ends of the two sections of each assembly together.

8. The invention defined in claim 7 in which said tension rod comprises two portions joined by a turnbuckle located intermediate the ends of the full length of the tension rod.

9. A building having opposed side walls, a cap strip extending along the top of each side wall and secured thereto, said strip having upright projections fixed thereto at spaced intervals, several spaced primary rafters each separate from the others from one end to the other comprising inverted channels fitting over said projections and bolted thereto, and roof panels extending transversely of the several primary rafters parallel with the side walls of the building and carried by said primary rafters, said roof panels having secondary rafters which are also inverted channels on the underside thereof arranged and spaced to fit over said primary rafters, and fastening means attaching said secondary rafters of the roof panels to the primary rafters, each panel having a deck carried by the secondary rafters, and purlins under the deck extending between the secondary rafters.

* * * * *